US007997547B1

(12) United States Patent
Maus

(10) Patent No.: US 7,997,547 B1
(45) Date of Patent: Aug. 16, 2011

(54) ROLL-UP SIGN MOUNTING BRACKET

(75) Inventor: Geoffrey B. Maus, Mission Viejo, CA (US)

(73) Assignee: Traffix Devices, Inc., San Clemente, CA (US)

( * ) Notice: Subject to any disclaimer, the term of this patent is extended or adjusted under 35 U.S.C. 154(b) by 513 days.

(21) Appl. No.: 11/935,074

(22) Filed: Nov. 5, 2007

Related U.S. Application Data

(60) Provisional application No. 60/856,520, filed on Nov. 3, 2006.

(51) Int. Cl.
*E04G 3/00* (2006.01)

(52) U.S. Cl. ..... 248/219.3; 248/218.4; 248/219.4; 40/612

(58) Field of Classification Search ..... 248/219.1, 248/219.2, 219.3, 219.4, 218.4, 229.1
See application file for complete search history.

(56) References Cited

U.S. PATENT DOCUMENTS 2,447,228 A * 8/1948 Boston ..... 248/219.1
4,619,220 A * 10/1986 Seely et al. ..... 116/63 P
5,118,060 A * 6/1992 Spronken ..... 248/218.4
5,181,335 A * 1/1993 Todd ..... 40/606.13
5,231,778 A * 8/1993 Belobraydich et al. ..... 40/610
5,446,984 A 9/1995 Kulp et al.
5,472,162 A * 12/1995 Mason ..... 248/121
5,540,007 A 7/1996 Kulp et al.
5,624,092 A 4/1997 Kulp et al.
5,836,558 A 11/1998 Kulp et al.
6,003,827 A 12/1999 Kulp et al.
6,047,941 A 4/2000 Kulp et al.
6,079,678 A * 6/2000 Schott et al. ..... 248/229.15
6,237,883 B1 * 5/2001 Levin et al. ..... 248/176.1
6,430,855 B1 8/2002 Gertz et al.
6,755,381 B1 * 6/2004 Levin et al. ..... 248/163.1
2005/0184207 A1 * 8/2005 Bertram, III ..... 248/229.1

* cited by examiner

*Primary Examiner* — Amy J Sterling
(74) *Attorney, Agent, or Firm* — Stout, Uxa, Buyan & Mullins, LLP; Donald E. Stout

(57) ABSTRACT

A bracket for mounting an article, such as a roll-up fabric sign, on a mast, includes a body and a clamp on the body for securing the bracket at a desired location on the mast. A receptacle on the body is provided for receiving a portion of the article. The bracket body may be secured in first and second different orientations on the mast at the desired location, the first operational orientation being one in which the receptacle is positioned forwardly of a forward surface of the mast, for receiving the article portion, and the second non-operational orientation being one in which substantially no portions of the bracket body are positioned forwardly of the mast forward surface.

18 Claims, 3 Drawing Sheets

ROLL-UP SIGN MOUNTING BRACKET

This application claims the benefit under 35 U.S.C. 119(e) of the filing date of Provisional U.S. Application Ser. No. 60/856,520, entitled Roll-Up Sign Bracket, filed on Nov. 3, 2006. This provisional application is expressly incorporated herein, in its entirety, by reference.

BACKGROUND OF THE INVENTION

This application relates to signs and message display devices, and more particularly to adjustable brackets for attaching such signs to support stands for display to the public.

Signs used in the roadway construction field may be of the rigid type, constructed of metal, plywood, or the like, or may be of the flexible type, constructed of fabric or vinyl and designed to roll up for transport and storage when not in use. The signs may be of any shape, such as diamond, square, rectangular, or circular, and may be of varying sizes, depending upon the distance from which the signs must be viewed.

Portable, metallic sign stands are commonly used to support both rigid and flexible or roll-up types of signs. For example, the assignee of the present application, TrafFix Devices, Inc. of San Clemente, Calif., makes and sells several types of such sign stands, under, for example, the registered trademarks SUPER BUSTER, LITTLE BUSTER, BIG BUSTER, ECONO BUSTER, and the trademark TRI BUSTER. The TRI BUSTER sign stand is disclosed in co-pending and commonly assigned U.S. application Ser. No. 11/935,085, entitled Portable Sign Stand and filed on even date herewith, which application is herein expressly incorporated by reference.

Typically, rigid sign brackets may be left on the sign stand if a roll-up sign needs to be used. However, when a rigid sign is to be employed, the roll-up sign bracket must be removed from the sign stand. Removing the roll-up sign bracket in the event of the need to use a rigid sign often results in damage to or loss of the roll-up sign bracket.

SUMMARY OF THE INVENTION

The roll-up sign bracket of the present invention is designed to freely and easily rotate to a stowage position, without the need for removal from the sign stand, when it is desired to mount a rigid sign panel to the sign stand.

More particularly, a bracket is provided for mounting an article on a mast, which comprises a body, a clamp on the body for securing the bracket at a desired location on the mast, and a receptacle on the body for receiving a portion of the article. Forward portions of the bracket body comprise angled surfaces so that when the bracket body is secured to the mast in a particular orientations, no portions of the bracket body extend substantially forwardly of a forward side of the mast. The body preferably comprises opposing side walls and a rear wall, and the clamp extends through the rear wall.

The claim preferably comprises a bolt and nut combination and has a proximal handle for rotating the bolt. The angled surfaces, in a preferred embodiment, are on each of the side walls. The side walls each have a substantially horizontal lower edge, and the angled surfaces each extend upwardly from their respective lower edges toward a front end of the bracket body at a predetermined angle. In a preferred embodiment, the predetermined angle is between about 30° and about 60°. In a most preferred embodiment, the predetermined angle is about 45°. The receptacle comprises a slot in each of the opposing side walls.

In another aspect of the invention, there is provided a bracket for mounting an article on a mast, which comprises a body and a clamp on the body for securing the bracket at a desired location on the mast. A receptacle on the body is provided for receiving a portion of the article. The bracket body may be secured in first and second different orientations on the mast at the desired location, the first orientation being one in which the receptacle is positioned forwardly of a forward surface of the mast, for receiving the article portion, and the second orientation being one in which substantially no portions of the bracket body are positioned forwardly of the mast forward surface.

Preferably, the body comprises opposing side walls and a rear wall, and the clamp extends through the rear wall. The clamp comprises a bolt and nut combination and has a proximal handle for rotating the bolt. Each of the side walls include angled surfaces thereon. The side walls each have a substantially horizontal lower edge, and the angled surfaces each extend upwardly from their respective lower edges toward a front end of the bracket body at a predetermined angle. In a preferred embodiment, the predetermined angle is between about 30° and about 60°, and in a most preferred embodiment, the predetermined angle is about 45°.

Again, with reference to a preferred embodiment, the receptacle comprises a slot in each of the opposing side walls. The bracket body is moved from the first orientation to the second orientation by rotating the bracket body upwardly and rearwardly.

In still another aspect of the invention, there is disclosed a method of reorienting a bracket disposed on an upstanding mast from an operational orientation, for securing an article to the mast, to a non-operational orientation, without removing the bracket from the mast. The method comprises loosening a clamp which secures the bracket in the operational orientation, wherein a receptacle on the bracket is disposed forwardly of a forward surface of the mast for receiving a portion of the article. Then, the bracket is rotated rearwardly through a predetermined angle to the non-operational orientation, wherein no substantial portion of the bracket is disposed forwardly of the forward surface of the mast. The clamp is then re-tightened to secure the bracket in the non-operational orientation.

The invention, together with additional features and advantages thereof, may best be understood by reference to the following description taken in conjunction with the accompanying illustrative drawing.

DESCRIPTION OF THE PREFERRED EMBODIMENT

Figure 1:
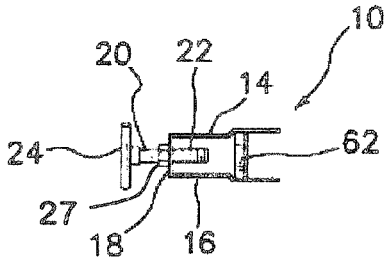
FIG. 1 is a bottom view of a roll-up sign bracket constructed in accordance with the principles of the present invention.
Figure 2:
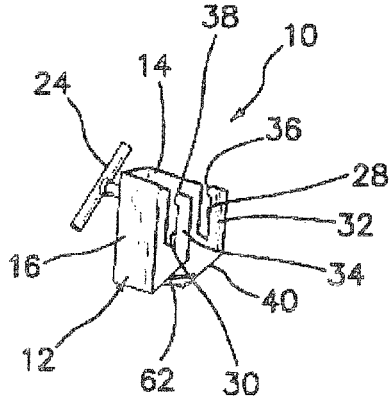
FIG. 2 is a perspective view of the roll-up sign bracket of FIG. 1.

Referring now more particularly to the drawings, there is shown in FIGS. 1-4 a roll-up sign bracket 10 constructed in accordance with one embodiment of the present invention. The bracket 10 comprises a body 12, comprised, preferably, of metal, such as steel. In a presently preferred embodiment, the body 12 is comprised of 0.080-0.100 inch thick galvanized steel. Of course, other suitable rigid, durable materials may be used, such as alternative metals or plastics. The body 12 comprises opposing side walls 14, 16 and a rear wall 18. A bolt 20 having threads 22 on one end thereof and a T-handle 24 on the opposing end extends through a hole 26 on the rear wall 18, as well as a nut 27, which is preferably welded to the wall 18. Corresponding slots 28, 30 are disposed on the front ends of each of the side walls 14, 16, as shown particularly in FIGS. 2 and 3.

The slots 28, 30 are adapted to receive the horizontal pultrusion for supporting a flexible sign, as will be described more fully below. Accordingly, frontwardly of the slots 28, 30 are upstanding fingers 32, 34, each of which include upper hooks 36, 38, respectively, overhanging a portion of the respective slots 28, 30. The hooks 36, 38 function to retain the pultrusion in the slots 28, 30.

Figure 3:
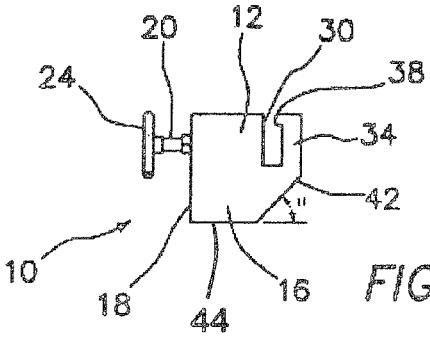
FIG. 3 is a side view of the roll-up sign bracket of FIGS. 1 and 2.
Figure 4:
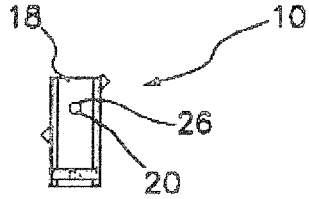
FIG. 4 is a front view of the roll-up sign bracket of FIGS. 1-3.

An important feature of the present invention is that the bottom portion of each side wall 14, 16, respectively, cuts sharply upwardly toward the front edge thereof, to create an angled edge 40, 42, respectively. As shown in FIG. 3, an angle θ between the angled edge 42 and a line extending from bottom edge 44 is approximately 45°, though the angle may actually fall within a range of approximately 30° to 60° and still be adapted to function effectively for the purposes of this invention. In the preferred embodiment, the angle θ for the other angled edge 40, which is not specifically shown in the drawings, should be approximately the same as the illustrated angle θ.

Figure 5:
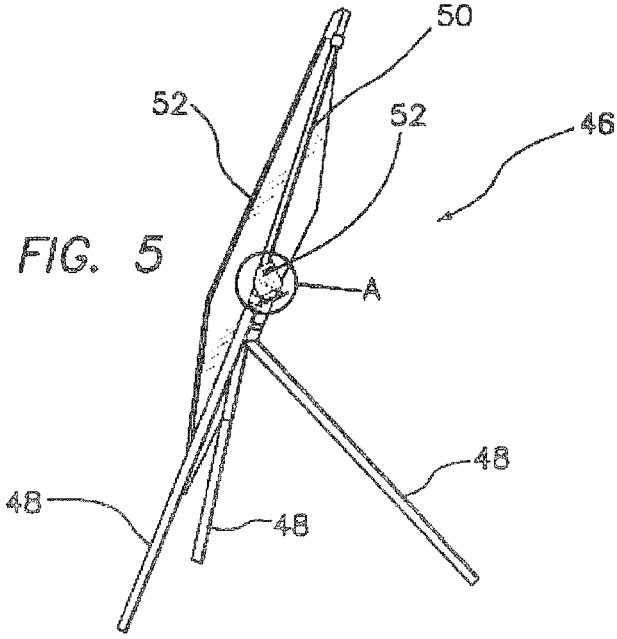
FIG. 5 is a perspective view of a sign stand on which the bracket of FIGS. 1-4 has been installed and on which a rigid sign is mounted.
Figure 6:
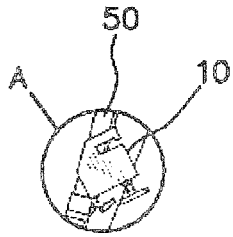
FIG. 6 is a detail view of the portion of FIG. 5 denoted by the circle A.

Now referring particularly to FIGS. 5 and 6, there is shown in FIG. 5 a portable sign stand 46 having a plurality of support legs 48 and a mast 50. As shown, the sign stand 46 is supporting a rigid sign panel 52. Importantly, even though a rigid sign panel 52 is deployed on the sign stand, the roll-up sign bracket 10 of the present invention remains installed on the sign stand. This will be discussed in more detail below.

Figure 7:
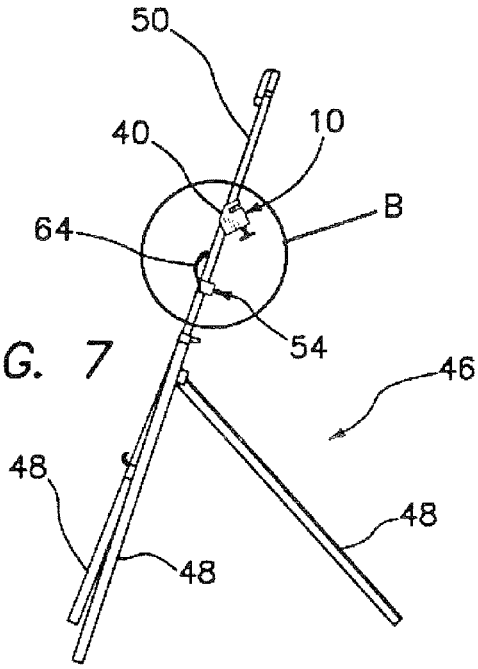
FIG. 7 is a perspective view of a sign stand illustrating both a prior art roll-up sign bracket and a roll-up sign bracket in accordance with the present invention installed thereon, for comparison purposes.
Figure 8:
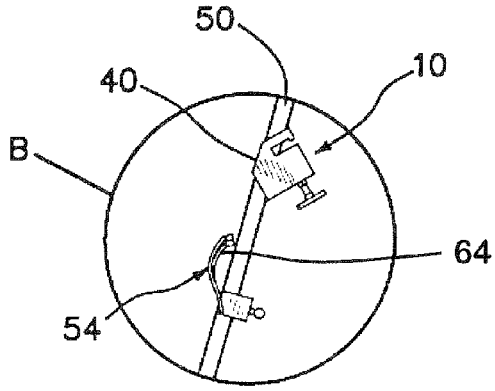
FIG. 8 is a detail view of a portion of FIG. 7 denoted by the circle B.

FIGS. 7 and 8 illustrate a sign stand 46, similar to that in FIGS. 5 and 6, but in FIGS. 7 and 8 no sign panel is illustrated, for clarity. A roll-up sign bracket 10, of the invention, is installed thereon, in a manner similar to that on FIGS. 5 and 6. Also installed thereon is a typical prior art roll-up sign bracket 54, for comparative purposes, to be discussed in more detail below.

Figure 10:
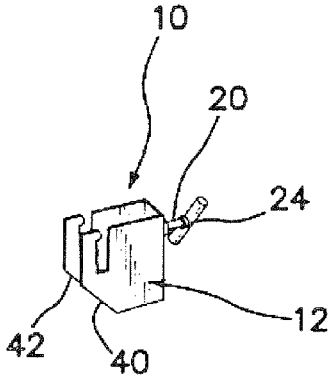
FIG. 10 is a perspective view, in isolation, of the roll-up sign bracket installed on the sign stand of FIG. 9.
Figure 9:
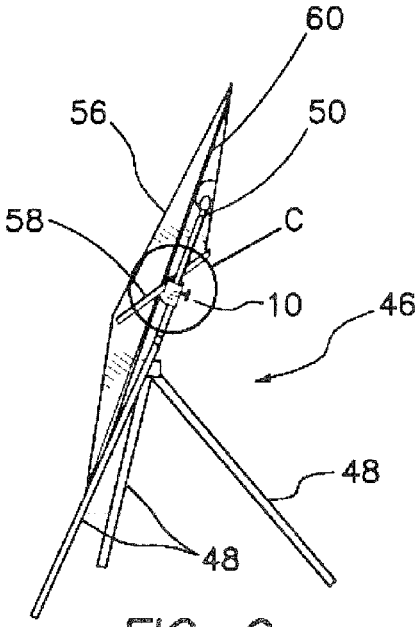
FIG. 9 is a perspective view of a sign stand on which is disposed a roll-up fabric or vinyl sign and a roll-up sign bracket according to the present invention.
Figure 11:
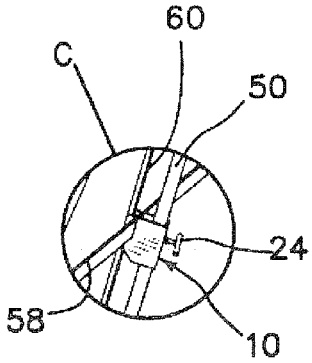
FIG. 11 is a detail view of a portion of FIG. 9 denoted by the circle C.

Now referring to FIGS. 9-11, there is shown yet another sign stand 46 of the type previously shown. In this instance, a roll-up fabric or vinyl sign panel 56 is deployed on the sign stand, as illustrated. The sign panel 56 is supported by crossed horizontal and vertical pultrusions 58 and 60, respectively.

Both the top and bottom portions of the bracket 10 are open, except for an angled cross-member 62 (FIG. 1), which is disposed at an angle approximately the same as angle θ. Thus, to mount the roll-up bracket 10 on the sign stand 46, the bracket 10 is slipped over the mast 50, as shown in FIGS. 9 and 11, so that the mast is disposed in the space within the body 12 defined by the side walls 14 and 16, the rear wall 18, and the angled cross-member 62. When the bracket 10 is located at a desired position along the mast 50, such as the position shown in FIGS. 9 and 11, the operator turns the T-handle 24 in a clockwise direction to advance the distal threaded end 22 of the bolt 20 toward the front end of the bracket 10. Ultimately, with sufficient advancement of the bolt 20, the mast will become clamped between the bolt 20 and the angled cross-member 62, thus securing the bracket 10 in the desired position.

Once the bracket 10 is secured, the slots 28 and 30 are disposed on the front side of the mast 50. At this juncture, the horizontal pultrusion 58 of the flexible sign 56 can be positioned within the two slots 28 and 30, so that it lies horizontally through both slots and extending from each side, as shown.

In a preferred embodiment, the bracket 10 weights about 0.25 lb., and has overall dimensions of approximately 3.125 in.×3.250 in.×4.562 in. The slots 28 and 30 are sized to receive pultrusions having a thickness of up to 0.375 in. The bracket is adapted particularly to fit a mast 50 size of approximately 1 in.×1 in., which is a typical size. Masts are usually fabricated of hollow metallic square tubing. Of course, the bracket 10 can be adapted to fit any reasonably sized sign stand mast and sign frame pultrusion.

Now again referring to FIGS. 5 and 6, when it is desired to place a rigid sign 52 on the stand 46, rather than having to remove the bracket 10 from the mast 50, the operator need only turn the T-handle 24 counter-clockwise sufficiently to loosen the bracket relative to the mast 50, and then rotate the bracket backwards as shown, so that the slots 28 and 30 and the remainder of the front portion of the bracket 10 move upwardly to the orientation shown in FIG. 6. The T-handle 24 can then be re-tightened to secure the bracket in this new orientation, with the mast 50 still clamped between the distal end of the bolt 20 and the angled cross member 62. The rigid sign 52 can then be installed, using one or more rigid sign brackets or other suitable mounting means.

FIGS. 7 and 8 are included to visually illustrate a significant advantage of the present bracket 10 relative to prior art brackets, such as prior art roll-up sign bracket 54. As shown, the prior art bracket 54 presents a front portion 64 thereof which extends frontally of the mast 50 at all times when the bracket 54 is installed. This bracket frontal portion prevents the rigid sign 52 from proper disposition on the sign stand. Accordingly, this type of bracket must be removed before the sign panel 52 is installed, with consequent additional labor and potential bracket loss or damage.

On the other hand, as discussed above, the inventive bracket 10 may merely be rotated backwardly, through approximately the angle θ, as shown. Because of the angled edges 40 and 42, once rotated, the bracket lies substantially flush along the mast 50, as shown, thereby permitting a rigid sign 52 to lie freely in front of the mast.

Figure 12:
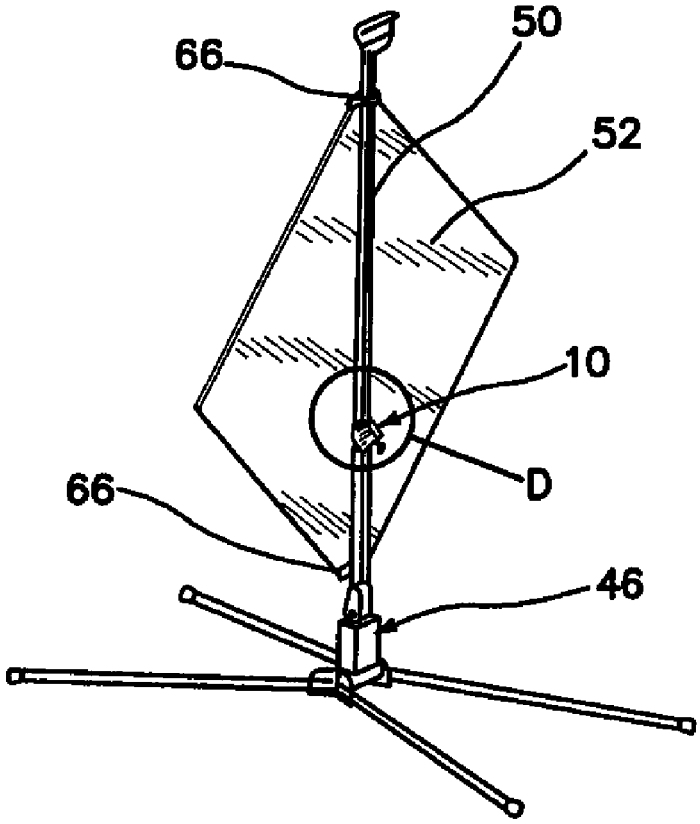
FIG. 12 is a perspective view of a sign stand having a roll-up sign bracket in accordance with the present invention.
Figure 13:
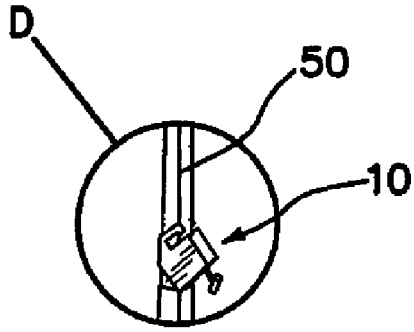
FIG. 13 is a detail view of a portion of FIG. 12 denoted by the circle D.

FIGS. 12 and 13 illustrate a different type of wind-yielding portable sign stand 46, on which a rigid sign 52 is installed, by means of rigid sign brackets 66. The inventive bracket 10 has been rotated backwardly to its storage position, as discussed above, to permit the sign panel 52 to be properly installed.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A bracket for mounting an article on a mast, comprising:

a body, said body comprising opposing side walls and a rear wall;

a clamp on said body extending through said rear wall for securing said bracket at a desired location on the mast, by engaging the mast at a rear side of the mast; and a receptacle on the forward portion of the bracket body for receiving a portion of the article on a forward side of the mast and forwardly of a forward surface of the mast, the bracket body being in a first orientation, wherein forward portions of said bracket body further comprise angled surfaces such that said angled surfaces enable the bracket body to be secured to the mast in a second orientation different from the first orientation, wherein no portions of the bracket body extend substantially forwardly of said forward side of the mast.

2. The bracket as recited in claim 1, wherein said clamp comprises a bolt and nut combination and has a proximal handle for rotating the bolt.

3. The bracket as recited in claim 1, wherein said angled surfaces are on each of said side walls.

4. The bracket as recited in claim 3, wherein said side walls each have a substantially horizontal lower edge, and said angled surfaces each extend upwardly from their respective lower edges toward a front end of the bracket body at a predetermined angle.

5. The bracket as recited in claim 4, wherein the predetermined angle is between about 30° and about 60°.

6. The bracket as recited in claim 5, wherein the predetermined angle is about 45°.

7. The bracket as recited in claim 2, wherein said receptacle comprises a slot in each of said opposing side walls.

8. The bracket of claim 2 wherein the bracket body further comprises an angled cross member connecting said opposing side walls such that the mast is disposed in the space within the bracket body defined by said side walls, rear wall and angled cross member.

9. The bracket as recited in claim 8, wherein said angled cross member comprises a surface which is oriented at an angle of between approximately 30° and 60° relative to an approximately horizontal orientation of a bottom edge of one of said side walls.

10. A bracket for mounting an article on a mast, comprising:

a body, said comprising opposing side walls and a rear wall;

a clamp on the body extending through said rear wall for securing the bracket at a desired location on the mast, by engaging the mast at a rear side of the mast; and a receptacle on the forward portion of the bracket body for receiving a portion of the article on a forward side of the mast and forwardly of a forward surface of the mast, wherein forward portions of said bracket body comprise angled surfaces and wherein the bracket body may be secured in first and second different orientations on the mast at the desired location, the first orientation being one in which the receptacle is positioned forwardly of said forward surface of the mast, for receiving said article portion, and the second orientation being one in which said angled surfaces enable the bracket body to be secured such that no portions of the bracket body are positioned substantially forwardly of the forward surface of the mast.

11. The bracket as recited in claim 10, wherein said angled surfaces are on each of said side walls.

12. The bracket as recited in claim 10, wherein said side walls each have a substantially horizontal lower edge, and said angled surfaces each extend upwardly from their respective lower edges toward a front end of the bracket body at a predetermined angle.

13. The bracket as recited in claim 12, wherein the predetermined angle is between about 30° and about 60°.

14. The bracket as recited in claim 13, wherein the predetermined angle is about 45°.

15. The bracket as recited in claim 10, wherein said receptacle comprises a slot in each of said opposing side walls.

16. The bracket as recited in claim 10, wherein said bracket body is moved from said first orientation to said second orientation by rotating said bracket body upwardly and rearwardly.

17. The bracket as recited in claim 10, and further comprising an angled cross member connecting said opposing side walls.

18. The bracket as recited in claim 17, wherein said angled cross member comprises a surface which is oriented at an angle of between approximately 30° and 60° relative to an approximately horizontal orientation of a bottom edge of one of said side walls.

* * * * *